US008629422B2

(12) United States Patent
Ryan et al.

(10) Patent No.: US 8,629,422 B2
(45) Date of Patent: Jan. 14, 2014

(54) DEPOSITION OF MATERIALS

(75) Inventors: Kevin M. Ryan, County Limerick (IE); Shafaat Ahmed, Limerick (IE)

(73) Assignee: University of Limerick, Limerick (IE)

( * ) Notice: Subject to any disclaimer, the term of this patent is extended or adjusted under 35 U.S.C. 154(b) by 362 days.

(21) Appl. No.: 13/125,377

(22) PCT Filed: Nov. 5, 2009

(86) PCT No.: PCT/IE2009/000077
§ 371 (c)(1),
(2), (4) Date: Apr. 21, 2011

(87) PCT Pub. No.: WO2010/052693
PCT Pub. Date: May 14, 2010

(65) Prior Publication Data

US 2011/0193054 A1 Aug. 11, 2011

(30) Foreign Application Priority Data

Nov. 5, 2008 (IE) ..... 2008/0887

(51) Int. Cl.
*H01L 29/06* (2006.01)

(52) U.S. Cl.
USPC ..... 257/9; 257/E21.479; 257/E29.072; 977/762; 977/764; 977/773

(58) Field of Classification Search
USPC ..... 257/9, E21.479, E29.072; 977/762, 977/764, 773; 205/109
See application file for complete search history.

(56) References Cited

U.S. PATENT DOCUMENTS

| | | | | |
|---|---|---|---|---|
| 6,127,283 | A * | 10/2000 | Gal-Or et al. | 438/785 |
| 6,660,152 | B2 * | 12/2003 | Nayfeh et al. | 205/109 |
| 2003/0089611 | A1 | 5/2003 | Nayfeh | |

FOREIGN PATENT DOCUMENTS

| | | |
|---|---|---|
| WO | 2005/014889 | 2/2005 |
| WO | 2006/008736 | 1/2006 |

OTHER PUBLICATIONS

S. Ahmed et al., "Close-Packed Gold-Nanocrystal Assemblies Deposited with Complete Sensitivity into Lithographic Trenches," Advanced Materials, Oct. 22, 2008, vol. 20, No. 24, pp. 4745-4750.
C.B. Murray et al., "Synthesis and Characterization of Monodisperse Nanocrystals and Close-Packed Nanocrystals Assemblies," Annual Review of Material Science, 2000, vol. 30, pp. 545-610.

* cited by examiner

*Primary Examiner* — Minh-Loan T Tran
(74) *Attorney, Agent, or Firm* — Jacobson Holman PLLC

(57) ABSTRACT

The method utilizes a conducting trench base with non-conducting trench walls to corral charged particles precisely into the trenches. The nanoparticles are close packed in the channels and highly ordered. This approach utilizes the charge on the particles to selectively deposit them within the trenches, as all nanoparticles in solution can be charged, and this can be extended to any nanoparticle system beyond gold. Also, this method results in the layer-by-layer growth of the gold nanoparticles. Therefore the depth of the nanoparticle layers within the trenches is controllable. This allows the possibility of heterolayered structures of different nanoparticle layers. Further this method ensures that assembly occurs to fill the void space available provided the back-contacting electrode is more conducting than the trench walls. This allows nanoparticle assemblies to be corralled into any lithographically defined shape, which makes this approach highly adaptable to a range of applications.

27 Claims, 4 Drawing Sheets

DEPOSITION OF MATERIALS

INTRODUCTION

Field of the Invention

The invention relates to deposition of materials, particularly materials at the nano scale of about 1 nm to 100 nm.

Assemblies of nanoparticles such as spherical nanoparticles or nanocrystals are of significant commercial interest in the emerging fields of nanoelectronics, nanophotonics and nanomagnetic data storage. Typically the assemblies are of monodisperse particles where each particle is coated with a layer of organic surfactant. For example, in close-packed spherical nanocrystal assemblies of metal and semiconductor nanocrystals the inter-nanocrystal coupling has been shown to depend on nanocrystal size, internanocrystal spacing and type of co-ordinating ligand [1] (Murray, Kagan et al. 2000) Modulation of these parameters either before or after organisation can allow nanocrystal assemblies of a metallic element, for example, to behave as a metal, insulator or semiconductor Gold nanocrystal superlattices with insulating binders are of specific interest in non-volatile memory devices where the electrically isolated nanocrystals act as charge storage centres. Such nanocrystal devices are expected to be more scaleable than conventional memory owing to the absence of oxide defects. The coupling effects observed in close-packed nanocrystal ensembles which exhibit metallic or semi-conducting behaviour can further be tuned to exhibit quantized charging of the molecular capacitance which is the fundamental basis for single electron transistors.

Such nanocrystal assemblies have significant application in a wide range of emerging nanotechnology industries from semiconductor to photonics.

The invention is directed towards achieving more precise placement of nanocrystals, for example into supercrystal structures.

[1] Murray, C. B., C. R. Kagan, et al. (2000). "Synthesis and characterization of monodisperse nanocrystals and close-packed nanocrystal assemblies." *Annu. Rev. Mater. Sci.* 30: 545-610.

SUMMARY OF THE INVENTION

According to the invention, there is provided a method of producing a material with a highly ordered close packed nanoparticle array, the method comprising the steps of:

providing a substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array.

In one embodiment, the trench is formed by lithography.

In another embodiment, the substrate is of doped semiconductor material.

In one embodiment, the trench walls are formed by an insulating oxide.

In one embodiment, the substrate is subsequently etched after deposition of the nanoparticles to leave free-standing islands of the nanoparticle array.

In one embodiment, the trench is formed in an oxide layer over doped semiconductor, the thickness of the oxide at the trench base being sufficiently small to allow the base to act as a conductor.

In another embodiment, the oxide forming the trench base has a thickness in the range of 1 nm to 5 nm.

In one embodiment, the oxide thickness over the doped semiconductor is in the range of 20 nm to 40 nm at the trench side walls.

In one embodiment, control of deposition results in hexagonal or cubic close packed ordering of the particles.

In one embodiment, the method occurs for sufficient time for the nanoparticles to be deposited layer-by-layer in which there is supercrystallisation arising from each incoming nanoparticle finding a preferred location on growing crystal.

In another embodiment, the solution has an organic solvent.

In one embodiment, the nanoparticles are ligand-coated.

In one embodiment, migration of the particles to the trench bases is influenced by charged surfactants on the particle surfaces In one embodiment, inherent or induced charge on particles is used to achieve controlled migration in the solvent.

In one embodiment, the nanoparticles include a metal.

In one embodiment, the nanoparticles include a semiconductor.

In another embodiment, the nanoparticles are nanorods or nanowires.

In one embodiment, the nanoparticle concentration is in the range of $0.1_\times10^{-5}$ mol $dm^{-3}$ to $0.1_\times10^{-2}$ mol $dm^{-3}$ In one embodiment, the thickness of the deposit is controlled by setting height of the trench walls, the deposition stopping when the deposited material reaches the height of the trench side walls.

In one embodiment, deposition occurs with two distinct particle sizes in the solution to form a bimodal close-packed assembly in channels.

In one embodiment, close-packed assemblies of particles are formed in the trenches to provide alternate crystals of metal and semiconductor.

In one embodiment, the nanoparticles include a semiconductor and the method comprises the step of tuning the band gap of the deposited material by adjusting the size, spacing, and ligand of the particles, and setting the dimensions of the trench.

In one embodiment, the solution includes dilute HF.

In another aspect, the invention provides a substrate coated having deposited thereon a nanoparticle array deposited in a method as defined above in any embodiment.

DETAILED DESCRIPTION OF THE INVENTION

Brief Description of the Drawings

The invention will be more clearly understood from the following description of some embodiments thereof, given by way of example only with reference to the accompanying drawings in which.

DESCRIPTION OF THE EMBODIMENTS

A material with a highly ordered packing of nanoparticles is achieved in the invention. The term "highly ordered" includes hexagonal or cubic close packing of the nanoparticles or nanocrystals. An electrophoretic deposition technique corrals gold nanoparticle assemblies precisely in lithographic channels by utilising the charge on the nanoparticle to achieve migration in organic solvents under the influence of an applied electric field.

FIG. 1 shows:

(*a*) TEM micrograph of as-synthesised gold nanoparticles showing a particle size of ~8 nm (scale bar=50 nm), in which a selected area electron diffraction inset of these gold nanoparticles shows that these are crystalline.

(*b*) Distribution of gold nanoparticles sizes, obtained by counting more than 1000 discrete particles.

(*c*) Schematic of an experimental set-up for nanocrystal assembly consisting of parallel gold coated copper electrodes completely immersed in a solution of gold nanocrystals in toluene.

(*d*) Curves alpha and beta which are the current time curves with and without the addition of gold nanoparticles in the anhydrous toluene respectively (corresponding axis is shown by an arrow).

(*e*) SEM image of pattern showing square and rectangular trenches back-etched on to highly doped silicon from the 30 nm silica layer in cross-hair patterns of 10 features repeated 25 times in the 100 μm×100 μm area.

Figure 1:
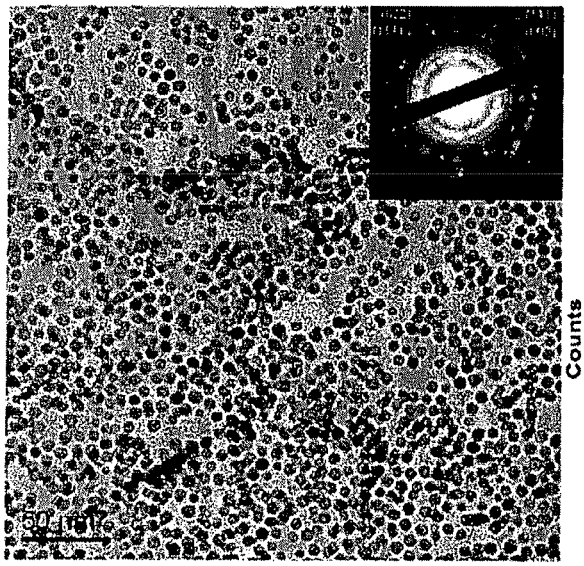
FIG. 1(*a*); is a micrograph of a nanocrystal assembly achieved according to the invention, FIG. 1(*b*) is a plot showing nanocrystal size distribution, FIG. 1(*c*) is a sketch showing an experimental set-up for the electrophoretic deposition, FIG. 1(*d*) is a plot of current density vs. time for the electrophoretic deposition, and FIGS. (*e*) and 1(*f*) are additional micrographs showing deposition.
Figure 1:
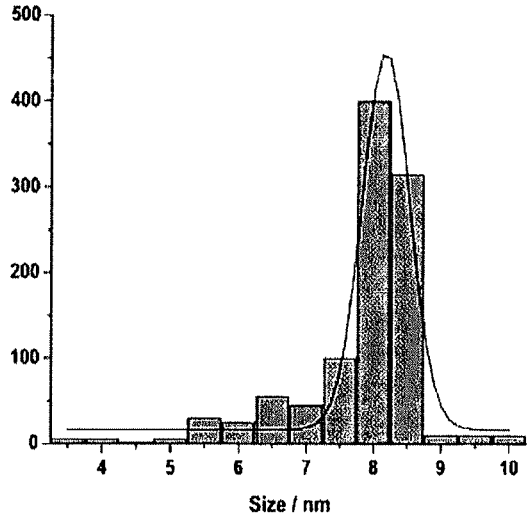
Figure 1:
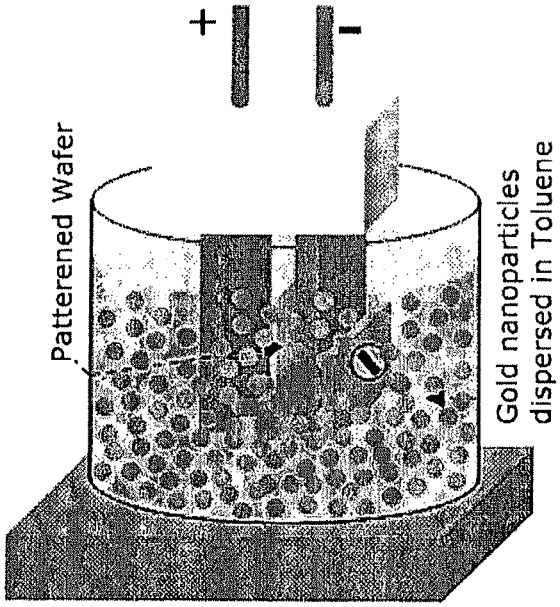
Figure 1:
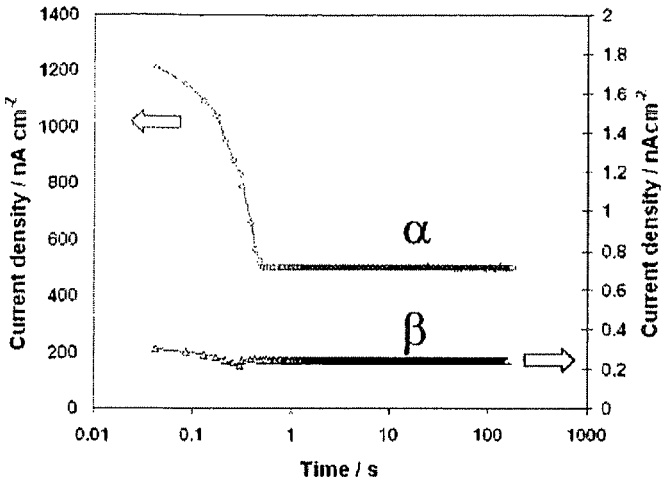
Figure 1:
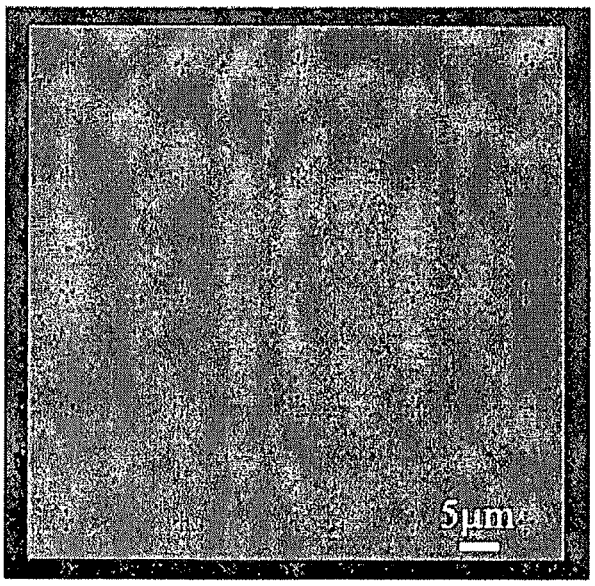
Figure 1:
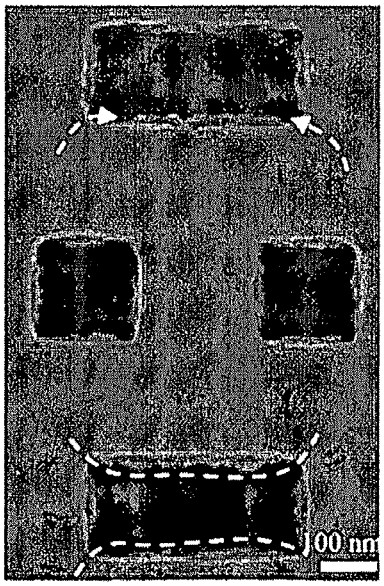
Figure 2:
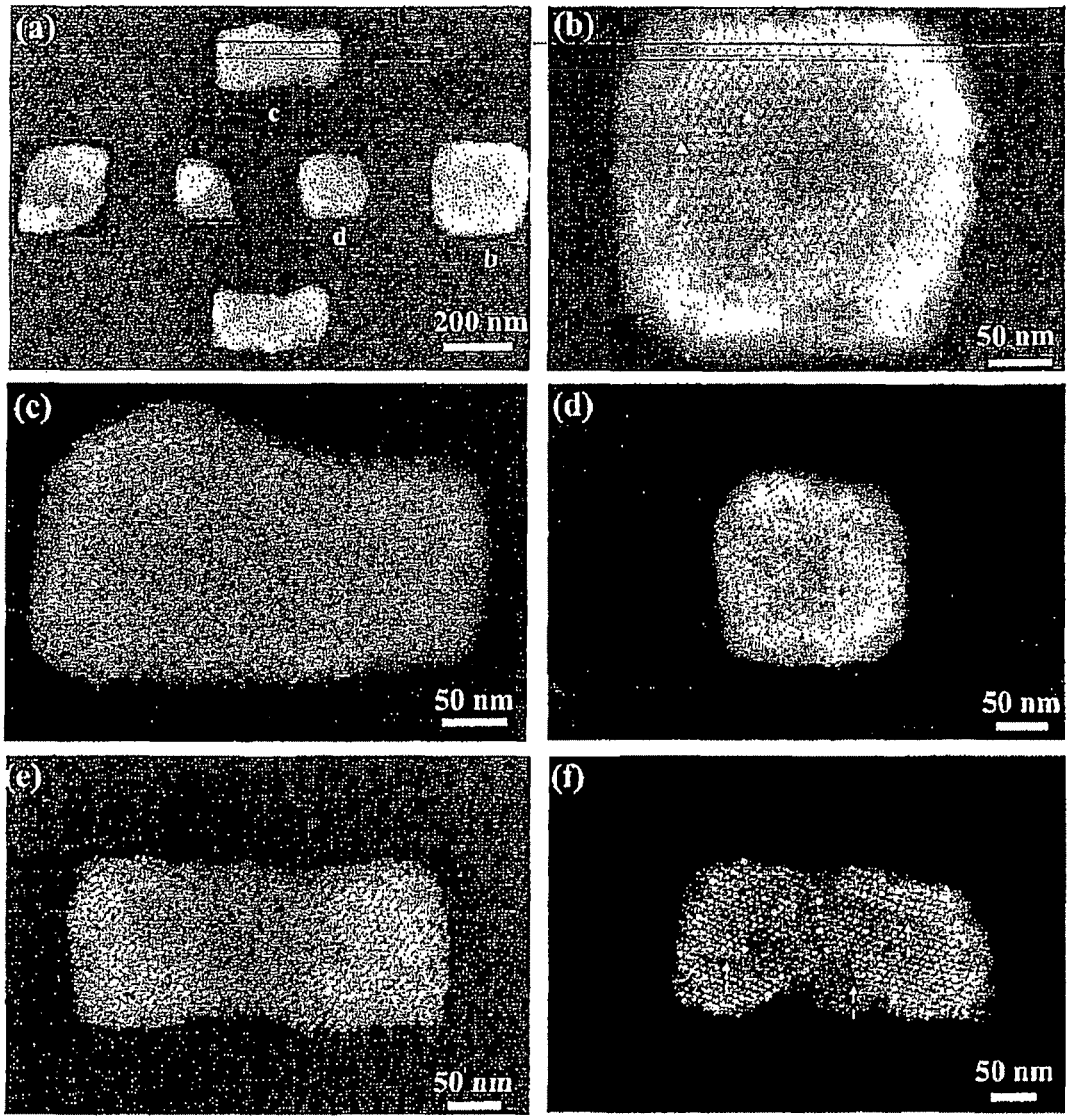
FIG. 2 is a set of SEM images of packed nanocrystals.

After nanoparticle deposition, the close packed assembly within the trench features was analysed by High Resolution Scanning Electron Microscopy (HRSEM). This is shown in FIG. 2:

(*a*) An SEM image of central rectangular and square features after gold nanocrystal infill (scale bar=200 nm).

(*b*)-(*d*) Closed packed gold nanocrystals assemblies in square and rectangular trenches further magnified from a.

(*e*)-(*f*) Gold nanocrystal infill in trenches arbitrarily taken from 250 trench array (scale bar=50 nm). The arrows shown in (*f*) are terraced regions clearly observable on the surface. Close packing of the nanocrystals is visible in all of trenches as shown in (*b*)-(*f*). The high resolution SEM clearly shows that close packing of nanocrystals was obtained in lithographically defined trenches with a very high degree of precision. This solves the problem of integrating close packed assemblies as a single step in the multi-step process of semiconductor manufacture. Considering the applications of close-packed assemblies as single electron devices, data storage and as nanophotonic devices the route described here will have significant application across a range of nanotechnological devices.

Method

The method utilises a conducting trench base with non-conducting trench walls to corral charged particles precisely into the trenches. The nanoparticles are close packed in the channels and highly ordered. This approach utilises the charge on the particles to selectively deposit them within the trenches, as all nanoparticles in solution can be charged, and this can be extended to any nanoparticle system beyond gold. Also, this method results in the layer-by-layer growth of the gold nanoparticles. Therefore the depth of the nanoparticle layers within the trenches is controllable. This allows the possibility of heterolayered structures of different nanoparticle layers. Further this method ensures that assembly occurs to fill the void space available provided the back-contacting electrode is more conducting than the trench walls. This allows nanoparticle assemblies to be corralled into any lithographically-defined shape, which makes this approach highly adaptable to a range of applications.

In more detail, a set-up of one embodiment for this process includes parallel plate electrodes separated at 1 mm and connected to a high voltage source. The channelled trenches are fabricated using a known process by electron beam lithography. The deposited channels are a prototype of what is possible using this technique. The invention includes use of any device that utilises conducting trench bases with non-conducting walls with electrophoretic deposition from non-aqueous or aqueous solution for the deposition of close-packed arrays of semiconductor or metal nanoparticles on wafer substrates, and applications thereof.

The particles are deposited layer-by-layer. For close packed assembly to occur, the process is essentially a super-crystallisation one, where each incoming nanocrystal finds its preferred location on the growing crystal. This process with monodisperse nanocrystals on a flat trench base was observed to result in packing of the assemblies layer by layer.

In general, the following are the preferred parameters: applied field of 100 to 300 V DC, in one embodiment 200 V DC, and a nanoparticle concentration of $0.1_\times10^{-5}$ mol $dm^{-3}$ to $0.1_\times10^{-2}$ mol $dm^{-3}$, in one embodiment $0.1_\times10^{-3}$ mol $dm^{-3}$ in toluene with a size range of 1 to 200 nm, more preferably 2 to 20 nm. The substrate in one embodiment consists of p-type silicon with a 30 nm $SiO_2$ layer back etched in square and rectangular features to expose the p-type silicon at the base of the trench.

In one embodiment, an SiO2 layer over the doped silicon is not completely back-etched leaving a residual oxide on the trench base of 1-5 nm thickness. The differential in the oxide thickness between the trench walls (range 30-200 nm) and the residual oxide on the trench base (1-5 nm) results in the bending of field lines to the trench base and preferential ordered assembly of particles to the trench under electrophoresis. The residual oxide can then function as a gate oxide in transistor device applications of the assemblies, allowing modulation of current flow between source and drain contacts patterned to connect to either side of the trench.

In a further gate oxide embodiment, the native SiO2 is grown to the desired thickness and back etched completely to the wafer. A non native oxide can be grow in the trenches by atomic layer deposition, for example, HfO2 (1-5 nm) achieving a gate layer between the assembly and the trench base.

EXAMPLE

A stable solution of gold nanocrystals (nc) in toluene was prepared following as follows. An aqueous solution of hydrogen tetrachloroaurate ($HAuCl_4$, Sigma-Aldrich, 99.9+ %, 30 ml of $30\times10^{-3}$ mol $dm^{-3}$) was mixed with tetraoctylammonium bromide $(C_4H_9)_4NBr$, Sigma-Aldrich, 99%) in toluene (80 ml of $50\times10^{-3}$ mol $dm^{-3}$). The two-phase mixture was vigorously stirred until all of the tetrachloroaurate was transferred into the organic phase. Upon completion of this phase transformation, the organic phase turned deep orange colour while the aqueous phase become colourless. While continuing to stir, aqueous sodium borohydride ($NaBH_4$, Fluka, ≥99%, 25 ml of 0.4 mol $dm^{-3}$) was slowly added. After addition of $NaBH_4$, the orange colour of the organic phase change to ruby red. After further stirring for 1200 s the organic phase was extracted and washed once with 0.5 mol $dm^{-3}$ $H_2SO_4$ (BDH, 98%) for neutralization and five times with deionised water (18.3 M Ω–cm) and then dried with anhydrous sodium sulphate (Fluka, ≥99%). The resulting organic phase was separated by filtering and then made its final volume to 250 ml.

Patterned wafers (10 mm×10 mm) were attached into a negative electrode of two parallel gold coated copper electrodes which are separated 2 mm apart. Copper clamps were used to attach the wafers, ensuring robust electrical connection between the highly doped silicon substrate and the gold coated copper electrode. Before attachment, the wafers were cleaned in a sequence with acetone (300 s), methanol (300 s) and toluene (600 s) using an ultrasonic bath and then dried in an oven (Gallenkamp hot box oven) at 115±5° C. for 600 s.

For electric-field assisted deposition 1.5 ml of gold-nc containing organic solution was further diluted to 25 ml of toluene (1.5 ml solution shall contain $1.7718\times10^{-3}$ g of gold which is equivalent to $0.36\times10^{-3}$ mol $dm^{-3}$ gold). Electric field deposition was carried out at room temperature. During electric-field assisted deposition, the electrodes were completely immersed in a deposition bath and a negative potential of 200V was applied to the patterned wafer using a high voltage power supply unit (Griffin 5 kV EHT unit, Essex, UK) and voltage was monitored using Black star 3225 MP multimeter. Deposition was carried out for 180 s.

Patterned wafer surface topography and depth profiles were characterized by Veeco-Enviroscope atomic force microscopy (AFM) in contact mode using gold-coated silicon nitride probe. The images of the full patterned wafers before and after deposition of the gold nanocrystals layers were acquired using high resolution scanning electron microscopy (Hitachi S-4800 HRSEM). Gold nanocrystal size (~8 nm) was characterized using JEOL 2011 transmission electron microscope (TEM).

Centrifugation of the gold-nc containing solution was carried out using Hettich ZENTRIFUGEN Universal 32R. The zeta potential was measured using ZETASIZER 3000 HAS (Melvern instrument). During conductivity measurements of TOAB and gold nanocrystal containing toluene were carried out using the same power supply as above but current was monitored using Keithley 610A Electrometer which is capable to measure $10^{-11}$ amps with full scale deflection.

Application and Advantages

We characterized our assemblies by high resolution scanning electron microscopy (HRSEM) as shown in FIG. 2. Such close-packed assemblies deposited in lithographic channels have applications as follows:

New type of semiconductor materials: As these assemblies can behave as a metal, insulator or semiconductor, they essentially are a new form of semiconductor material with size-tuneable properties at the nanoscale. The ability to put this material exactly where it is needed for semiconductor applications is very important commercially.

Data storage applications with magnetic nanoparticles will allow orders of magnitude increases in storage capacity. The ability to incorporate such structures in a single step process of semiconductor manufacture will likely lead to commercial application.

The invention allows the ordered deposition of nanocrystals of spherical, rod and wire shapes to be aligned into pre-fabricated lithographic channels.

Close packed order is important if nanoparticle assemblies are to find particularly advantageous application in devices.

Ordered assemblies of nanoparticles are a new type of supercrystal which can be insulators, semiconductors or metals depending on the spacing between the particles.

Disordered assemblies do not have band gap control with respect to particle composition, particle size, and inter-particle spacing. Close packed assemblies can function as single electron transistors where the addition of a single charge is used as the switching component. Close packed assemblies of gold can be used as interconnects. Close packed assemblies of gold have been used to route light due to particle plasmonic properties. Close packed assemblies of semiconductor particles can be used in transistors, AND and OR Gate structures. Depending on the ligand, interparticle coupling can occur by either electron hopping or tunnelling. This can be controlled in an ordered close-packed assembly. Ordered arrays of wires and rods have applications in high density assemblies for the semiconductor industry. However, other groups have not addressed the problem of integration of ordered assemblies with semiconductor manufacture.

It will be appreciated that the method of assembly is based on particle migration from organic solutions under the influence of an electric field. In the invention organic solvents are used, which don't have the issue of water hydrolysis at the electrodes. Organic solutions for electrophoretic deposition are normally unstable whereas in this case the ligand coated nanoparticles are completely stable in the toluene mixture.

Layer-by-layer growth occurs, and so a precisely defined thickness of nanoparticle deposit can be formed.

The rate and order of growth can be defined by the voltage applied. Lower voltages result in slower growth and more ordered deposits.

Precise positioning is important as nanoparticles need to be localised exactly where they are needed on-chip with a high degree of precision.

Figure 3:
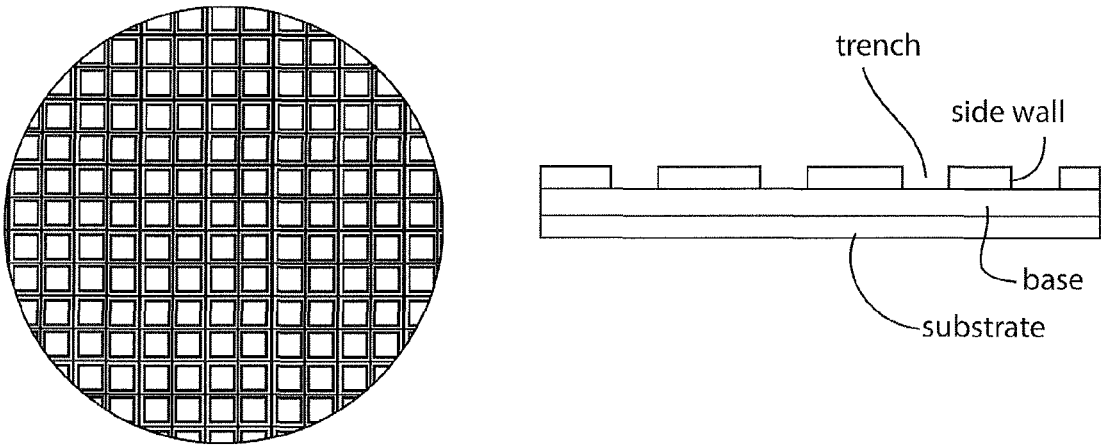
FIGS. 3 and 4 are diagrams showing an arrangement of nanocrystals achieved by the invention.
Figure 4:
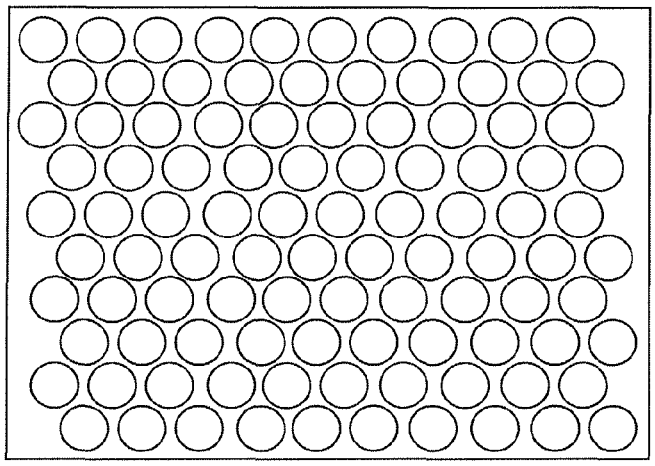

The semiconductor industry as an example requires the precise placement of nanocomponents (when utilised) exactly where they are needed on-chip. This is not an insignificant problem. For example if a single array of nanoparticles is required for a memory element. Methods are needed to localise these particles exactly where they are needed with high precision. Also, the integration of the nanoparticles needs to occur as a single stage in the multi-step process of semiconductor manufacture which can have up to 200 steps. Therefore, taking a wafer as shown in FIG. 3 which will eventually be diced into 150 individual chips, the deposition of nanoparticles will have to occur across the entire wafer in specific lithographic features. FIG. 4 shows a simplified cross-sectional view of the wafer showing typical trenches available after lithographic etch processes. Our approach is to make the base of the trench highly doped silicon with the trench walls of an insulating SiO2 layer grown from this substrate and back etched to the doped silicon in the arrays required. Under the influence of the electric field the nanoparticles migrate only to the trench bases and do not accumulate around the trenches.

Major advantages are:

Positional accuracy of deposits 1 in 4,000,000,000 based on size of wafer and area occupied by trenches Minimal deposition outside of trenches Layer-by-layer growth—such that thickness of deposit can be controlled by deposition time, voltage applied, and particle charge in addition to depth of the trenches Subsequent etching of the SiO2 layer results in free-standing islands of close-packed nanocrystal assemblies on a highly doped silicon substrate.

Trench dimensions can define order and consequent electrical and optical properties FIG. 4 shows a 10×10 array of nanoparticles 7 nm in diameter confined within a 100 nm×100 nm trench. The electrical transport properties of this array are defined by four parameters:

elemental composition of nanoparticle, inter-nanoparticle spacing, type of ligand spacer between the particles, and dimensions of the array.

In comparison to a bulk element of the same dimension its electrical properties are only defined by the band-gap or elemental composition of the material.

In this invention, the size, shape, elemental composition, type of ligand and ligand spacing can be tuned in addition to achieving complete positional accuracy in this step-by-step process. For example, monodisperse spherical nanocrystals of semiconductor (IV, II-VI, III-IV) can be synthesised with charged ligands and assembled into the channels in a similar process. The organic ligand spacer coordinates onto the nanocrystal during growth such that changing the surfactants in the growth regime for different alkyl chain lengths will allow a modulation of the interparticle spacing in the final assemblies. As an example, hexyl phosphonic acid has a chain length of 5 carbon units and can be replaced for octadecyl phosphonic acid with a chain length of 18 carbon units which will result in a larger spacing between each particle in the assemblies.

Referring again to FIG. 4, this shows a 10×10 array of particles. If the particle is magnetic each particle can store one bit of information in a read/write process by scanning across the sample. For this to work the exact position of each nanoparticle needs to be known in reference to the patterns defined on a wafer. As the particles are confined exactly in trenches the position of each particle is known with respect to the trench patterns and trench dimensions and read/write assay to individual particles is possible.

If the particle is semi-conducting, the band gap of the overall nanoparticle solid is tuneable by adjusting the size, spacing, ligand of the particle in addition to the dimensions of the trench. Consequently, the assemblies can function as components for semiconductor manufacture in interconnect, transistor, and gate applications.

The invention is not limited to the embodiments described but may be varied in construction and detail.

The invention claimed is:

1. A method of producing a material with a highly ordered close packed nanoparticle array, the method comprising the steps of:

providing a substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array, wherein the method occurs for sufficient time for the nanoparticles to be deposited layer-by-layer in which there is supercrystallisation arising from each incoming nanoparticle finding a preferred location on growing crystal.

2. The method as claimed in claim 1, wherein the trench is formed by lithography.

3. The method as claimed in claim 1, wherein the substrate is of doped semiconductor material.

4. The method as claimed in claim 3, wherein the trench is formed in an oxide layer over doped semiconductor, the thickness of the oxide at the trench base being sufficiently small to allow the base to act as a conductor.

5. The method as claimed in claim 4, wherein the oxide forming the trench base has a thickness in the range of 1 nm to 5 nm.

6. The method as claimed in claim 4, wherein the oxide thickness over the doped semiconductor is in the range of 20 nm to 40 nm at the trench side walls.

7. The method as claimed in claim 1, wherein the trench walls are formed by an insulating oxide.

8. The method as claimed in claim 1, wherein the substrate is subsequently etched after deposition of the nanoparticles to leave free-standing islands of the nanoparticle array.

9. The method as claimed in claim 1, where control of deposition results in hexagonal or cubic close packed ordering of the particles.

10. The method as claimed in claim 1, wherein the solution has an organic solvent.

11. The method as claimed in claim 1, wherein the nanoparticles are ligand-coated.

12. The method as claimed in claim 1, wherein migration of the particles to the trench bases is influenced by charged surfactants on the particle surfaces.

13. The method as claimed in claim 1, wherein inherent or induced charge on particles is used to achieve controlled migration in the solvent.

14. The method as claimed in claim 1, wherein the nanoparticles include a metal.

15. The method as claimed in claim 1, wherein the nanoparticles include a semiconductor.

16. The method as claimed in claim 1, wherein the nanoparticles are nanorods or nanowires.

17. The method as claimed in claim 1, wherein the nanoparticle concentration is in the range of $0.1\times10^{-5}$ mol $dm^{-3}$ to $0.1\times10^{-3}$ mol $dm^{-3}$.

18. The method as claimed in claim 1, wherein the thickness of the deposit is controlled by setting height of the trench walls, the deposition stopping when the deposited material reaches the height of the trench side walls.

19. The method as claimed in claim 1, wherein deposition occurs with two distinct particle sizes in the solution to than a bimodal close-packed assembly in channels.

20. The method as claimed in claim 1, wherein close-packed assemblies of particles are formed in the trenches to provide alternate crystals of metal and semiconductor.

21. The method as claimed in claim 1, wherein the nanoparticles include a semiconductor and the method comprises the step of tuning the band gap of the deposited material by adjusting the size, spacing, and ligand of the particles, and setting the dimensions of the trench.

22. The method as claimed in claim 1, wherein the solution includes dilute HF.

23. A substrate and a deposited nanoparticle array deposited therein according to a method as comprising the steps of: providing the substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array, wherein the method occurs for sufficient time for the nanoparticles to be deposited layer-by-layer in which there is supercrystallisation arising from each incoming nanoparticle finding a preferred location on growing crystal.

24. A method of producing a material with a highly ordered close packed nanoparticle array, the method comprising the steps of:

providing a substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array, wherein the thickness of the deposit is controlled by setting height of the trench walls, the deposition stopping when the deposited material reaches the height of the trench side walls.

25. A method of producing a material with a highly ordered close packed nanoparticle array, the method comprising the steps of:

providing a substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array, wherein deposition occurs with two distinct particle sizes in the solution to form a bimodal close-packed assembly in channels.

26. A method of producing a material with a highly ordered close packed nanoparticle array, the method comprising the steps of:

providing a substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array, wherein close-packed assemblies of particles are formed in the trenches to provide alternate crystals of metal and semiconductor.

27. A method of producing a material with a highly ordered close packed nanoparticle array, the method comprising the steps of:

providing a substrate with a trench having a base and side walls, the base being conductive and the walls being non-conductive, providing a solution of dispersed charged nanoparticles, applying an electrical field using the substrate as an electrode so that nanoparticles migrate by electrophoresis from the solution into the trench and form a packed array, wherein the nanoparticles include a semiconductor and the method comprises the step of tuning the band gap of the deposited material by adjusting the size, spacing, and ligand of the particles, and setting the dimensions of the trench.

* * * * *